US006386847B1

(12) United States Patent
Bush et al.

(10) Patent No.: US 6,386,847 B1
(45) Date of Patent: May 14, 2002

(54) SCROLL COMPRESSOR HAVING CLUTCH WITH POWERED REVERSE ROTATION PROTECTION

(75) Inventors: James W. Bush, Skaneateles, NY (US); John R. Williams, Bristol, VA (US); Zili Sun; Carlos Zamudio, both of Arkadelphia, AR (US); Jason Hugenroth, Hope, AR (US); Greg Hahn; Thomas Barito, both of Arkadelphia, AR (US); Joe T. Hill, Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/725,364

(22) Filed: Nov. 29, 2000

(51) Int. Cl.[7] ..... F01C 1/02
(52) U.S. Cl. ..... 418/55.5; 418/57; 418/69
(58) Field of Search ..... 418/55.5, 57, 69

(56) References Cited

U.S. PATENT DOCUMENTS

| | | | | | |
|---|---|---|---|---|---|
| 4,998,864 | A | | 3/1991 | Muir | |
| 5,320,507 | A | | 6/1994 | Monnier et al. | |
| 5,545,019 | A | * | 8/1996 | Beck et al. | 418/55.1 |
| 5,580,229 | A | | 12/1996 | Beck et al. | |
| 5,772,415 | A | * | 6/1998 | Monnier et al. | 418/55.5 |
| 6,053,714 | A | * | 4/2000 | Fennochi et al. | 418/55.1 |
| 6,106,251 | A | * | 8/2000 | Monnier et al. | 418/55.5 |
| 6,179,592 | B1 | * | 1/2001 | Hugenroth et al. | 418/55.5 |

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor is provided with a clutch to minimize or eliminate the detrimental effects of reverse rotation. Generally, the clutch prevents rotation of the shaft during both powered and unpowered reverse rotation. The clutch could be subject to damage during powered reverse rotation, and thus a clutch protection mechanism is incorporated that will prevent the clutch from moving to an actuated position if powered reverse rotation occurs.

9 Claims, 3 Drawing Sheets

SCROLL COMPRESSOR HAVING CLUTCH WITH POWERED REVERSE ROTATION PROTECTION

BACKGROUND OF THE INVENTION

This invention relates to an improvement to a clutch for preventing reverse rotation in scroll compressors that prevents the clutch from engaging when powered reverse rotation occurs.

Scroll compressors are becoming widely utilized in refrigerant compression applications. In a scroll compressor, a pair of scroll members each have a base and a generally spiral wrap extending from the base. The spiral wraps interfit to define compression chambers. One of the two scroll members is caused to orbit relative to the other, and as the two orbit compression chambers defined between the interfitting scroll wraps decrease in volume, compressing a refrigerant.

One problem with scroll compressors is that they are designed to orbit in a single direction. If for some reason the scroll member orbits in a reverse direction, the results are undesirable.

Reverse rotation can occur in one of two ways. First, unpowered reverse rotation can occur at shutdown of the compressor. At some point, the force from the entrapped refrigerant can cause the orbiting scroll to be driven in the reverse direction. This is generally a short transient phenomena, and results in undesirable noise.

Another type of reverse rotation is powered reverse rotation. This type of reverse rotation generally occurs when a motor for driving the orbiting scroll is miswired. Powered reverse rotation can occur for longer periods of time, and will often result in damage to the compressor.

One proposed solution to reverse rotation is the use of a one-way clutch within the scroll compressor. In one type of clutch, the compressor is provided with a clutch member that is normally in a first position where it does not affect transmission of orbiting movement to the orbiting scroll, nor does it affect the scroll wraps being kept in engagement with each other sealing and defining compression chambers. In this known clutch, if reverse rotation occurs, the clutch member will rotate, and surfaces will lock and engage surfaces within the drive housing, creating a breaking action. This will slow or halt the reverse rotation, and will reduce the undesirable noise mentioned above.

One such proposed clutch is shown in U.S. Pat. No. 5,545,019. This clutch is beneficial for stopping unpowered reverse rotation. However, there has sometimes been problems with these systems during powered reverse rotation. In particular, during powered reverse rotation, the clutch members have sometimes been destroyed.

The present invention is thus directed to protecting clutches during powered reverse rotation. While the invention is disclosed with a clutch as in the above patent, other clutches may benefit.

SUMMARY OF THE INVENTION

In a disclosed embodiment of this invention, an eccentric pin on a driveshaft is received within a slider block for the orbiting scroll, as known. As farther generally known, the slider block and eccentric pin are structured such that during forward rotation flat surfaces on the eccentric pin engage the flat surfaces on the slider block to drive the orbiting scroll and also hold the orbiting scroll wrap against the non-orbiting scroll wrap.

However, should powered reverse rotation occur, a surface on the eccentric pin will engage a surface on the slider block, and cause the slider block to move out of position. The slider block will then engage a lug on an inner periphery of the clutch. With the slider block engaging the lug, the clutch will not be allowed to rotate to its engaged position. This movement of the slider block will not occur during unpowered reverse rotation.

In this way, the clutch will brake the shaft during non-powered reverse rotation, but the inventive structure prevents the clutch from engaging during non-powered reverse rotation. Thus, the clutch will be protected.

These and other features of the present invention can be best understood from the following specification and drawings, the following of which is a brief description.

DETAILED DESCRIPTION OF A PREFERRED EMBODIMENT

Figure 1:
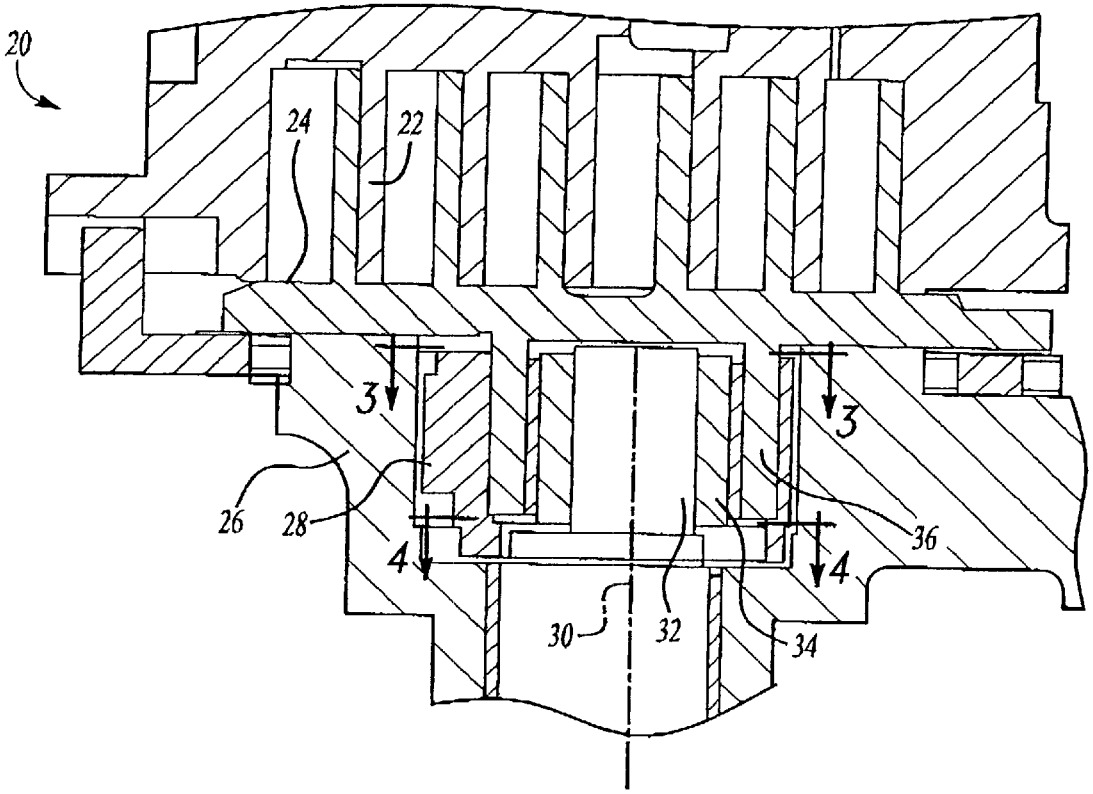
Fig-1 PRIOR ART
FIG. 1 shows a Prior Art scroll compressor.

FIG. 1 shows a scroll compressor 20 as is generally known in the prior art. A non-orbiting scroll 22 is held in a position where its wrap engages the wrap of an orbiting scroll 24. A crankcase 26 supports the orbiting scroll 24. A clutch 28 surrounds a driveshaft 30 having an eccentric pin 32 received within a slider block 34. A hub 36 from the orbiting scroll 24 surrounds the slider block 34.

Figure 2:
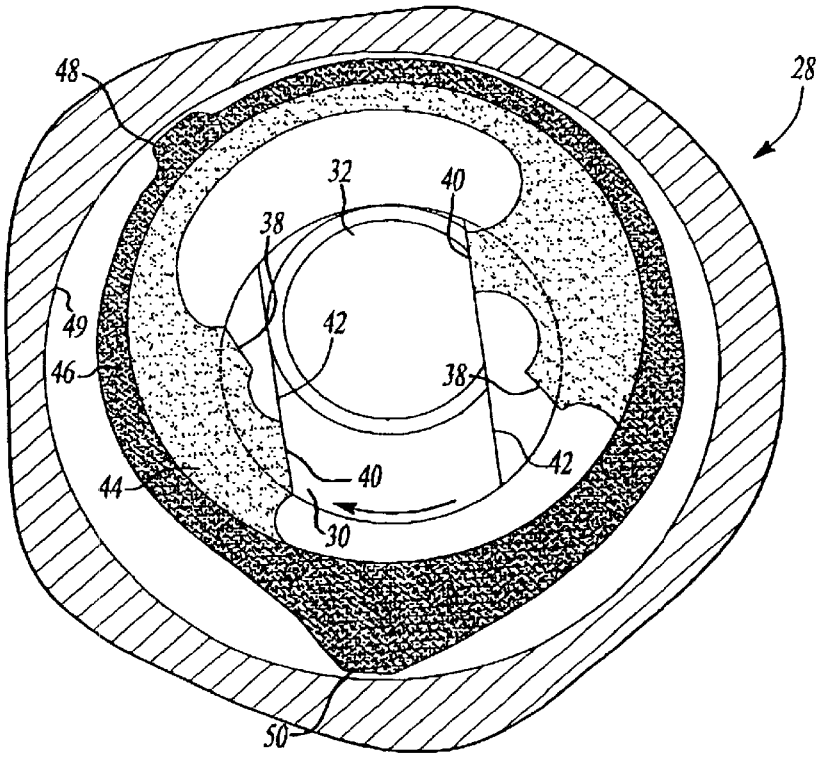
Fig-2 PRIOR ART
FIG. 2 is a cross-sectional view showing one feature known in the prior art.

As shown in FIG. 2, the clutch 28 is provided with surfaces 38 and 40 which selectively engage surfaces 42 on the shaft 30. During normal direction rotation, the clutch member is free to rotate within a bore 49 in the crankcase. An end wall 44 of the clutch has an upwardly extending hub 46. Friction pads 48 and 50 extend outwardly from the hub 46. In the position shown in FIG. 2, the entire structure is free to rotate as the orbiting scroll orbits. As described in greater detail in U.S. Pat. No. 5,545,019, this structure is designed to be in the position shown in FIG. 2 during normal rotation.

Figure 3:
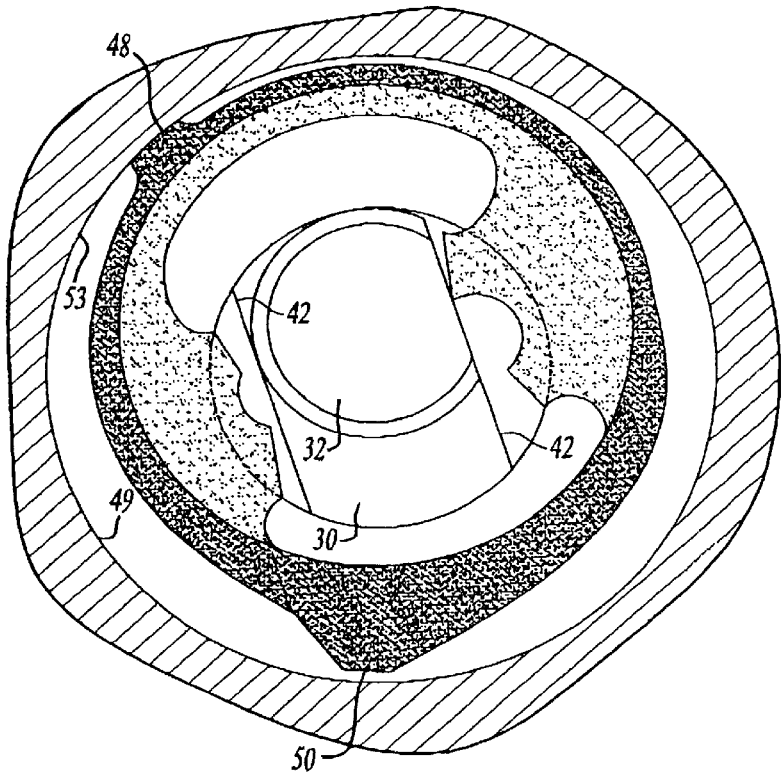
Fig-3 PRIOR ART
FIG. 3 shows another view of the Prior Art FIG. 2 structure moved to a distinct position.

FIG. 3 shows the movement of the clutch 28 as rotation slows at shutdown. As shown, one friction pad 48 now engages the inner surface 49. The other friction pad 50 has yet to engage. The clutch will now begin to slow rotation of the shaft.

Figure 4:
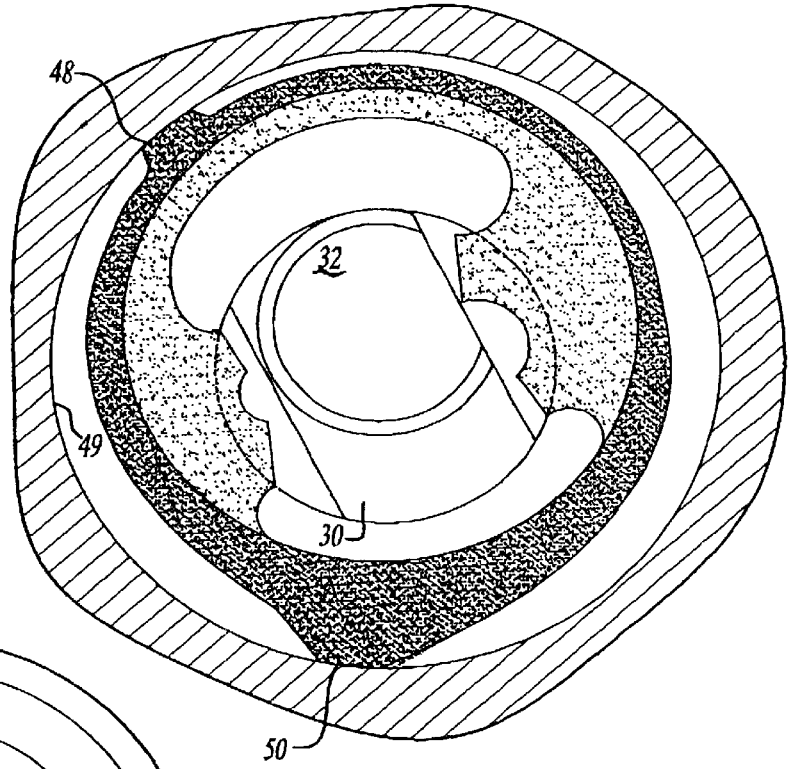
Fig-4 PRIOR ART
FIG. 4 shows an engaged view of a Prior Art clutch as shown in FIG. 2 and 3.

FIG. 4 shows the engagement of the friction pads 48 and 50 with a surface 49 as will occur when reverse rotation begins. The engagement of the friction pads 48 and 50 with surface 49 tends to slow or stop reverse rotation of the shaft. Again, the above description is as known in the art, and described in greater detail in the above-referenced U.S. Patent. The above-referenced U.S. Patent also predicted that the clutch would be beneficial for preventing powered reverse rotation. However, in practice, the clutches are often ruined when they experience powered reverse rotation when the motor has sufficient strength when powered in reverse to overcome the friction of pads 48 and 50. This can happen, for example, when the motor is a three phase induction motor.

Figure 5:
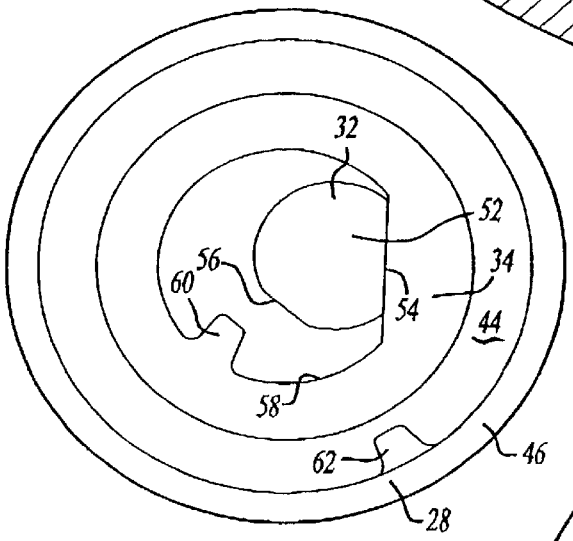
FIG. 5 shows an inventive structure in a normal position.
Figure 6:
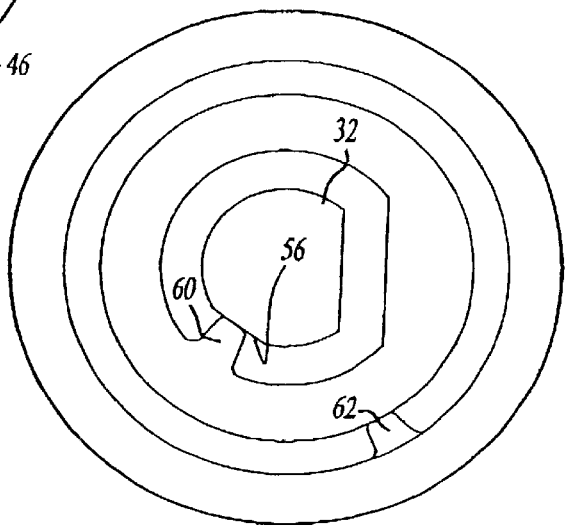
FIG. 6 shows the inventive structure in a position after undergoing powered reverse rotation.

FIG. 5 shows an improvement to the system of FIGS. 1–4. The eccentric pin 32 is provided with a flat face 52 selectively engaging a flat face 54 on the slider block 34, as known. The bore 58 of the slider block other than the flat surface 54 further has an actuating pin 60. Actuating pin 60 is selectively aligned with a flat 56 on the eccentric pin 32. A lug 62 extends radially inwardly from the hub 46 of the clutch 28. During forward rotation, the eccentric pin and slider block are held in the position shown in FIG. 5. In this position, the eccentric pin is forced in a direction such that its flat surface 52 is driven against the flat surface 54 and orbiting movement is transmitted to the orbiting scroll as is known.

In the event of unpowered reverse rotation, the forces between the slider block 34 and eccentric pin 32 are generally unchanged. The slider block 34 and drive shaft 30 slow to a stop under the influence of high pressure vapor trapped between the wraps of scrolls 22 and 24 and begin to accelerate in a reverse direction as the vapor begins to reexpand. Slider block 34 and eccentric pin 32 remain in normal engagement throughout this process and clutch 28 operated normally as is known. Note that "normal engagement" between slider block 34 and eccentric pin 32 may include some sliding motion between surfaces 52 and 54 as is known. Such sliding motion does not affect the operation of clutch 28.

However, should powered reverse rotation occur, the eccentric pin will initially move in a direction away from (to the right) from the flat surface 54 within the slider block 34. The surface 56 will contact the actuation pin 60. This then causes the slider block 34 to move to a position such that it contacts the lug 62. Once the lug 62 has been contacted, the rotating movement between the FIG. 2 position and the FIGS. 3 and 4 position of the clutch 28 is prevented. Thus, the clutch will be allowed to operate during unpowered reverse rotation, but prevented from operating during powered reverse rotation.

A worker in this art would know how to design an eccentric pin and slider block combination that would have the above-described movement.

While a particular clutch has been illustrated, and a particular arrangement of clutch protector has been illustrated, it should be understood that a worker in this art would be able to design other clutch protection mechanisms and that such clutch protection mechanisms would also protect other type clutches. For that reason the following claims should be studied to determine the true scope and content of this invention.

What is claimed is:

1. A scroll compressor comprising:

a first scroll member having a base and a generally spiral wrap extending from the wrap;

a second scroll member having a base and a generally spiral wrap extending from said base;

a driveshaft having eccentric pin drivingly engaging said second scroll to cause it to move in an orbital fashion; and a clutch for selectively protecting said compressor during reverse rotation, said clutch moving to an actuated position when reverse rotation occurs, said clutch having stop portions contacting a braking surface when reverse rotation occurs, and a clutch protection mechanism allowing said clutch to move to said actuated position during unpowered reverse rotation but contacting a surface during powered reverse rotation, and preventing said clutch from moving during powered reverse rotation.

2. A scroll compressor as recited in claim 1, wherein said clutch rotates to said actuated position from a normal position and said clutch protection mechanism not preventing said clutch from rotating during unpowered reverse rotation.

3. A scroll compressor as recited in claim 1, wherein said clutch protection mechanism including a surface contacting a slider block preventing said movement.

4. A scroll compressor as recited in claim 3, wherein said eccentric pin is provided with a flat contact surface for contacting a surface on said slider block mechanism.

5. A scroll compressor as recited in claim 4, wherein during powered reverse rotation said eccentric pin contacts said surface on said slider block causing said slider block to contact said clutch protection mechanism surface.

6. A scroll compressor comprising:

a first scroll member having a base and a generally spiral wrap extending from the wrap;

a second scroll member having a base and a generally spiral wrap extending from said base;

a driveshaft having eccentric pin drivingly engaging said second scroll to cause it to move in an orbital fashion;

a clutch for selectively protecting said compressor during reverse rotation, said clutch moving to an actuated position when reverse rotation occurs, and a clutch protection mechanism allowing said clutch to move to said actuated position during unpowered reverse rotation but preventing said clutch from moving during powered reverse rotation;

said clutch rotates to said actuated position from a normal position and said clutch protection mechanism not preventing said clutch from rotating during unpowered reverse rotation; and said second scroll member has an extending hub on said base opposite said wrap, said hub receiving a slider block, said eccentric pin extending into said slider block, and said clutch has an inner bore surrounding said slider block and at least one of said inner bore and said slider block being provided with a radially extending lug, said slider block being caused to move into contact with said inner bore at said lug upon the occurrence of powered reverse rotation and to prevent said clutch from rotating.

7. A scroll compressor as recited in claim 6, wherein said clutch is provided with engagement surfaces on radially outer surfaces which selectively engage a bore in a crankcase, said clutch moving to engage said surfaces in said bore, and said clutch protection mechanism preventing such movement.

8. A scroll compressor as recited in claim 6, wherein said eccentric pin selectively engages an actuation pin on an inner bore of said slider block when powered reverse rotation occurs, said engagement causing said slider block to move such that it contacts said engagement lug preventing rotation of said clutch.

9. A scroll compressor comprising:

a first scroll member having a base and a generally spiral wrap extending from the wrap;

a second scroll member having a base and a generally spiral wrap extending from said base, said second scroll member having a downwardly extending boss receiving a slider block;

a driveshaft having eccentric pin extending upwardly into said slider block; and a clutch for selectively protecting said compressor during reverse rotation, said clutch moving to an actuated position when reverse rotation occurs, and giving a clutch protection mechanism allowing said clutch to move to said actuated position during unpowered reverse rotation but preventing said clutch from moving during powered reverse rotation, said clutch rotating to said actuated position from a normal position and said clutch protection mechanism preventing said clutch from rotating, said clutch having an inner bore surrounding said slider block, at least one of said inner bore and said slider block being provided with a radially extending lug, said slider block being caused to move into contact with said inner bore at said lug upon the occurrence of powered reverse rotation and prevent said clutch from rotating, said clutch being provided with engagement surfaces on radially outer surface which selectively engage a bore and crankcase, said clutch moving to engage said surfaces in said bore, and said clutch protection mechanism preventing such movement during powered reverse rotation, said eccentric pin having a surface selectively engaging an actuation pin on an inner bore of said slider block when powered reverse rotation occurs, said surface causing said slider block to move such that it contacts said engagement lug, preventing rotation of said clutch.

* * * * *